United States Patent [19]

Fisher

[11] Patent Number: 4,670,939

[45] Date of Patent: Jun. 9, 1987

[54] DEVICE FOR HOLDING A DOOR OPEN WITH PERMANENT MAGNET ACTUATED BALL VALVE AFFECTING HYDRAULIC CYLINDER

[76] Inventor: Samuel H. Fisher, 2316 N. Overbrook Dr., Belleair Bluffs, Fla. 33540

[21] Appl. No.: 843,638

[22] Filed: Mar. 25, 1986

[51] Int. Cl.[4] ..... E05F 3/12

[52] U.S. Cl. ..... 16/297; 16/58; 16/323; 16/DIG. 9; 16/DIG. 17

[58] Field of Search ..... 16/297, 320, 343, 289, 16/DIG. 14, 323, 58, 66, 84, 82, DIG. 9, DIG. 10, DIG. 17; 251/65; 188/300, 299; 137/533.11, 522; 267/64.12

[56] References Cited

U.S. PATENT DOCUMENTS

| | | | |
|---|---|---|---|
| 1,565,770 | 12/1925 | Almesan | 188/299 |
| 2,005,457 | 6/1935 | Dubitsky et al. | 16/51 |
| 2,044,903 | 6/1936 | Grieshaber | 16/51 |
| 2,576,168 | 11/1951 | Allen | 251/65 |
| 3,212,122 | 10/1965 | Flint | 16/51 X |
| 3,321,210 | 5/1967 | Delchev | 188/313 X |
| 3,415,562 | 12/1968 | Petersen | 16/49 X |
| 3,852,846 | 12/1974 | Slaybaugh | 16/51 X |
| 4,102,004 | 7/1978 | Nagase | 16/49 |

OTHER PUBLICATIONS

"The Illustrated Encyclopedia of Science and Invention"; H. S. Stuttman Inc. pub., pp. 1696 and 1098.

*Primary Examiner*—Nicholas P. Godici
*Assistant Examiner*—G. M. Reid
*Attorney, Agent, or Firm*—Ronald E. Smith

[57] ABSTRACT

A hydro-magnetic door hold open device. A piston on a piston rod is slideably mounted in a cylinder that is mounted eccentrically inside a housing. The piston rod extends out of the housing and connects to a hingedly mounted door so that opening or closing of the door effects reciprocation of the piston within the cylinder. Both the housing and the cylinder within it are filled with hydraulic fluid. A ball valve positioned forwardly of the piston is confined within a valve chamber that has three seats; the inner cylinder is provided with apertures on the rearward side of the piston and forwardly of the valve chamber so that the ball valve is carried by the fluid into either of two of the seats attendant piston advancement or retraction and maintained in such seat by a pressure differential established in the fluid by the travel of the piston. A magnet external to the housing unseats the ball valve from either of the two seats and positions it in the third seat and this allows free swinging of the door when the door handle is manipulated.

4 Claims, 4 Drawing Figures

DEVICE FOR HOLDING A DOOR OPEN WITH PERMANENT MAGNET ACTUATED BALL VALVE AFFECTING HYDRAULIC CYLINDER

CROSS-REFERENCE TO RELATED APPLICATIONS

This disclosure is a substitution of a disclosure filed by the present inventor on 05/09/85, Ser. No. 06/732,302, now abandoned.

BACKGROUND OF THE INVENTION

1. Field of the Invention

This invention relates generally to devices that hold hinged doors open in preselected positions, and more particularly relates to a device that holds vehicle doors, trunk lids or hoods in any preselected open position.

2. Description of the Prior Art

Car doors are notorious for slamming shut at the worst of times; fingers have been smashed, knees have been bruised, and so on. Hoods and trunk lids have also been known to slam shut at the most inopportune times.

Creative individuals have turned their attention to the problem and have developed a numer of solutions.

For example, U.S. Pat. No. 2,005,457, issued June 18, 1935 to Dubitsky and others, discloses a doorcheck for releasably holding a door in a fully open position.

U.S. Pat. No. 2,044,903 issued June 23, 1936 to Grieshaber, discloses an automobile door control with a door closing link which closes the door under action of a spring controlled by a dash pot.

A 1965 U.S. Pat. No. 3,212,122, to Flint, discloses a hydraulic hold open device for doors.

An electrically controlled shock absorber system is shown in U.S. Pat. No. 3,321,210 to Delchev (1967).

A magnetic hold-open device that employs an electromagnet that holds a door open when the magnet is energized and which releases the door when the magnet is de-energized is shown in a 1968 patent to Petersen, U.S. Pat. No. 3,415,562.

U.S. Pat. No. 3,852,846, awarded in 1974 to Slaybaugh, discloses a door hold open attachment for a door check; it features a wholly enclosed valve operating armature.

U.S. Pat. No. 4,102,004 to Nagese (1978) discloses a device for controlling the opening or closing speed of a door; it includes a piston and piston rod assembly slideably positioned in the inner tube of a dual tube hydraulic cylinder.

The prior art neither teaches nor suggests that a hydro-magnetic means could be employed to control the movement of a ball valve in a door hold open device.

SUMMARY OF THE INVENTION

The present invention includes a cylindrical housing, a magnet mounted on a rocker arm external to the housing, an apertured cylindrical member positioned within the housing, a free floating ball valve positioned within a compartment of the inner cylinder, a piston slideably mounted for reciprocation within said inner cylinder, said piston having a piston rod connected to a door the opening and closing of which effects travel of said piston, and hydraulic fluid within said housing and said inner cylinder which is free to flow through the apertures formed in said inner cylinder.

Travel of the piston through the fluid effects travel of the ball valve and creates a pressure differential across the valve which holds it into position as long as magnetic forces are not acting upon it. The ball valve is free to float only within a comparment having three valve seats; when the door is being opened or closed, the ball valve is driven to a particular seat by the hydraulic fluid under the impulse of the piston. When the magnet external to the outer housing is brought into proximity of the ball valve, said ball valve is constrained by magnetic forces to position itself on its third seat.

Hydraulic devices are often not used in many applications because those skilled in the art of hydraulic are aware of the propensity of hydraulic devices to leak. The unique tube-in-tube construction of the present invention, however, reduces the possibilities of leakage to a minimum since the only possible leakage that can occur would be at the location where the piston rod exits the housing to connect with the vehicle's door.

Another drawback of hydraulic devices in general is their need for a return line; these return lines are also known to have leakage propensities.

The return line of the present invention is provided in a highly novel form in that it is built into the device itself. Thus, it sharply and distinctly contrasts with the return lines of the prior art which are external members that leak. The novel return line is provided in the absence of external parts by the unique tube in tube design of the present invention; specifically, the inner tube is mounted eccentrically with respect to the outer tube (housing); the inner tube is apertured at its opposite ends so that when the piston slides within it, fluid is free to flow through the apertures. Accordingly, the space provided by the eccentric mounting of the inner tube with respect to the housing serves as a return line and it is not susceptible to the leakage that plagues the return lines of the prior art.

It is the primary object of this invention to provide a device that holds a hingedly mounted door open at any desired position.

Another object is to accomplish the foregoing object hydro-magnetically.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
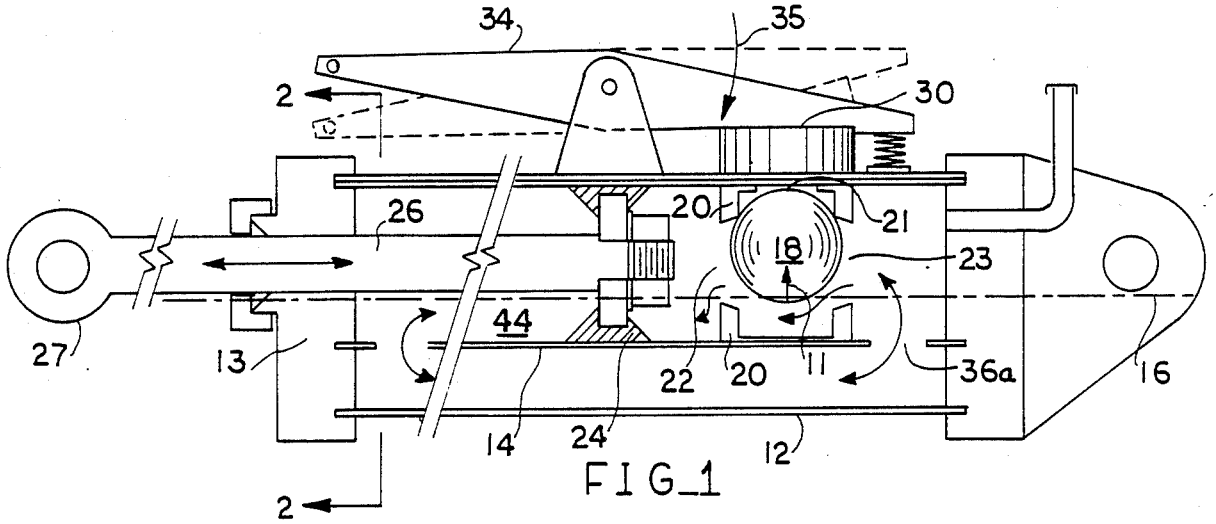
FIG. 1 is a cross-sectional view of the novel device illustrating the position of the ball valve and the position of the permanent magnet when the piston is free to reciprocate in the absence of resistance offerred by hydraulic fluid and the door to which it is linked is free to open or close.

Referring now to FIG. 1, it will there be seen that the novel device is designated by the reference numeral 10 as a whole.

Door hold open device 10 includes a cylindrical housing 12 and a cylinder 14 disposed therewithin; cylinder 14 is mounted eccentrically relative to the longitudinal axis of symmetry 16 of housing 12.

Device 10 further includes a free floating ball valve 18 that is disposed within cylinder 14 and confined by retainer member 20 at all times. Retainer member 20 includes three seats 21, 22 and 23 for ball valve 18 as shown.

Figure 3:
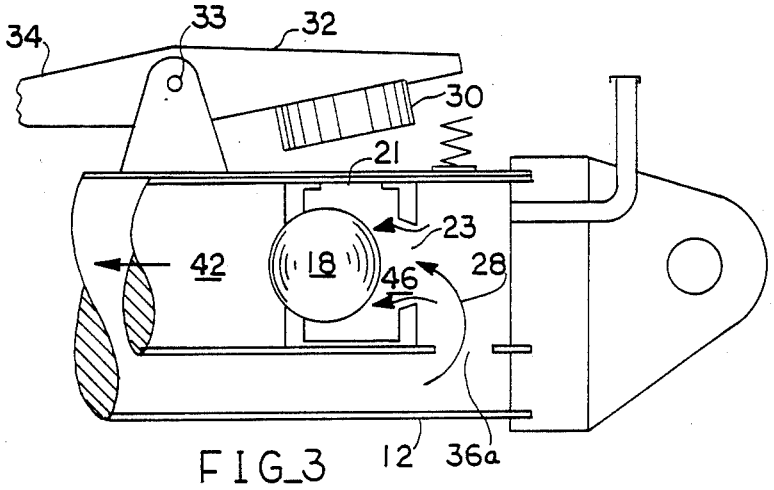
FIG. 3 is a fragmentary view of the right hand portion of the novel device illustrating the position of the ball valve and the position of the permanent magnet when the piston and hence the door is locked into a position into which said door was placed as a result of an opening action.
Figure 4:
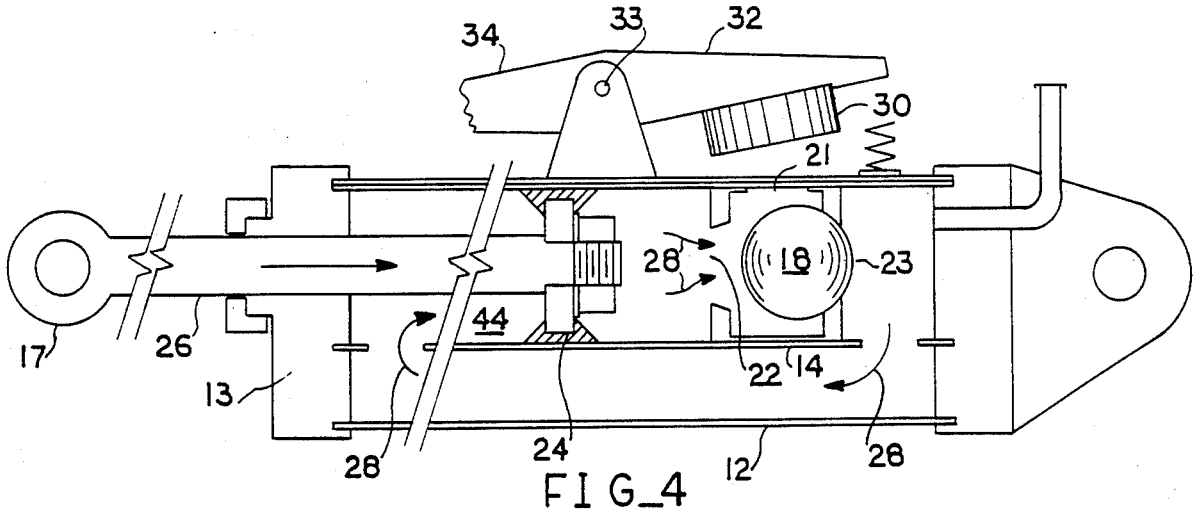
FIG. 4 is a cross-sectional view of the novel device illustrating the position of the ball valve and the position of the permanent magnet when the door is locked into a position into which it was placed as a result of a closing action.

As will be more fully understood as this description proceeds, when ball valve 18 is seated in seats 22 or 23, as depicted in FIGS. 3 and 4, respectively, the door held open by device 10 is locked into position; however, when valve 18 is seated in seat 21, as depicted in FIG. 1, the door is free to swing on its hinges.

Seat 22 is attained by valve 18 when the door is being swung open and seat 23 is attained when the door is being closed. A pressure differential established by piston reciprocation in the hydraulic fluid that fills both the housing and the inner cylinder retains valve 18 in seats 22 or 23, but a magnet retains it in seat 21 as will be discussed more fully as this description proceeds.

Piston 24 is slideably mounted within cylinder 14. Piston rod 26 extends through base 13 of housing 12 and its end 27 is connected to a preselected part of a door (not shown). When the door is being closed, piston 24 moves toward valve retainer 20 as shown in FIG. 4 and the flow of hydraulic fluid indicated by the directional arrows 28 displaces ball valve 18 until it seats in seat 23; when the door is being opened, piston 24 moves in the opposite direction and the fluid causes ball valve 18 to seat on seat 22 as shown in FIG. 3.

Permanent magnet 30 is mounted at one end of rocker arm 32 as shown. The opposite end 34 of rocker arm 32 is connected to a door handle, not shown. When the door handle is moved, as when the door is being opened or closed, rocker arm 32 pivots relative to its fulcrum 33 in the direction of arrow 35 in FIG. 1 so that magnet 30 is positioned in abutting relation to the outer surface of housing 12. The magnetic force attracts ball valve 18, displacing it in the direction of arrow 11 until it seats firmly in seat 21. Accordingly, seats 22 and 23 are open to the flow of hydraulic fluid and piston 24 is free to slide within cylinder 14 so that the door can swing freely in either an opening or closing direction.

Figure 2:
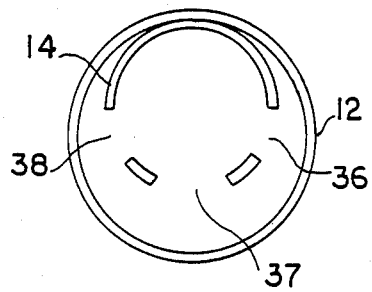
FIG. 2 is a sectional view taken along line 2—2 of FIG. 1.

As best shown in FIG. 2, circumferentially spaced openings 36, 37 and 38 are formed in the sidewalls of cylinder 14 at its left end; a corresponding set of openings are formed in its right end although in the drawings only aperture **36*a*** is shown.

When ball valve 18 secured in seat 21 by the action of magnet 30 as aforesaid, the fluid can be displaced by piston 24 due to said openings.

The area within housing 12 but external of cylinder 14 is designated 40 and can be understood as a return line for the fluid.

As shown in FIGS. 3 and 4, when the door handle is released, magnet 14 is displaced away from housing 12 by the pivoting action of rocker arm 32. This allows ball valve 18 to float freely in response to the flow of the hydraulic fluid. When the door is being opened (FIG. 3), piston rod 26 is in tension. The seating of ball valve 18 on seat 22 prevents the flow of fluid through the ball valve compartment 20; due to the retraction of piston 24, however, the pressure of the fluid between the compartment 20 and piston 24, i.e., in space 42 which expands during such retraction, drops while the pressure of the fluid on the other side of the ball valve 18 increases as the space behind the piston, denoted 44, decreases in size. This establishes a pressue differential across ball valve 18 and such differential maintains the valve 18 in its seat. The pressure increase in space 44 is of course transmitted substantially undiminished, in accordance with Pascal's Principle, to space 46 to the right of ball valve 18.

A pressure differential of opposite polarity is established across vave 18 when the door is swung in a closing direction, since in such case space 44 expands, causing the pressure of the fluid therein to drop, while spaces 42 and 46 decreas in size, causing the pressure of the fluid therein to increase.

The strength of magnet 30 must be sufficient to overcome the effects of the pressure differentials that seat the ball valve in seats 22 or 23.

Those skilled in the art of machine design will appreciate that the device may be constructed of various materials. The outer and inner cylinder are preferably constructed of non-ferrous metal, and ball valve 18 is preferably made of steel.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A device for holding a hingedly mounted door open in any preselected position, comprising:

a cylindrical, hollow housing member;

a fixed position cylindrical member;

said cylindrical member eccentrically mounted within said housing member and abuttingly engaging an interior sidewall of said housing member;

a magnet mounted externally of said housing member and moveable into and out of abutting relation to said housing member responsive to manipulation of a door handle;

said magnet positioned relative to said housing member in a position closest to said cylindrical member mounted within said housing member;

a ball valve member;

a valve chamber for retaining said ball valve member;

said valve chamber being fixedly positioned within said cylindrical member at a first end thereof and being positioned in the magnetic field of said magnet when said magnet abuts said housing member;

said valve chamber defining three distinct seats into which said ball valve member may seat;

hydraulic fluid filling said housing member, said cylindrical member and said valve chamber;

a piston slideably mounted within said cylindrical member;

a first aperture formed in said cylindrical member at a first end thereof and a second aperture formed in said cylindrical member at a second, opposite end thereof;

said piston and said valve chamber being positioned intermediate said first and second apertures; and means for connecting said piston to the door to be locked so that swinging of said door effects travel of said piston within said cylindrical member.

2. The device of claim 1, wherein said means for connecting said piston to the door includes a piston rod to which said piston is mounted, said piston rod having its non-piston carrying end extending out of said housing member and being connected to a preselected part of said door so that swinging of said door translates into slideable motion of said piston within said cylindrical member.

3. The device of claim 2, further comprising a pivotally mounted rocker arm member having a pair of laterally extending arms, said magnet mounted to a first one of said arms and a door handle connected to a second one of said arms so that operation of said door handle effects pivoting of said rocker arm and hence movement of said magnet toward and away from said housing member.

4. The device of claim 3, wherein said valve chamber defines a first seat positioned in proximity to said magnet, a second seat positioned in proximity to said piston, and a third seat positioned diametrically opposite said second seat.

* * * * *